US008123561B2

(12) United States Patent
Zhang

(10) Patent No.: US 8,123,561 B2
(45) Date of Patent: Feb. 28, 2012

(54) ELECTRICAL CONNECTOR SHIELDING SHELL

(75) Inventor: Xue-Hai Zhang, Xuzhou (CN)

(73) Assignee: Molex Incorporated, Lisle, IL (US)

( * ) Notice: Subject to any disclaimer, the term of this patent is extended or adjusted under 35 U.S.C. 154(b) by 205 days.

(21) Appl. No.: 12/223,138

(22) PCT Filed: Jan. 26, 2007

(86) PCT No.: PCT/US2007/002188

§ 371 (c)(1),
(2), (4) Date: Jul. 22, 2010

(87) PCT Pub. No.: WO2007/089594

PCT Pub. Date: Aug. 9, 2007

(65) Prior Publication Data

US 2010/0279545 A1 Nov. 4, 2010

(30) Foreign Application Priority Data

Jan. 26, 2006 (CN) ..... 2006 2 0002130 U

(51) Int. Cl.
*H01R 13/648* (2006.01)

(52) U.S. Cl. ..... 439/607.31

(58) Field of Classification Search ... 439/607.31–607.4
See application file for complete search history.

(56) References Cited

U.S. PATENT DOCUMENTS 5,147,214 A 9/1992 Korsunsky et al.
6,991,494 B1 1/2006 Spink, Jr.

FOREIGN PATENT DOCUMENTS

TW 273 862 8/2005

OTHER PUBLICATIONS

International Search Report for PCT/US2007/002188.

*Primary Examiner* — Khiem Nguyen
(74) *Attorney, Agent, or Firm* — Stephen L. Sheldon

(57) ABSTRACT

An electrical connector having a shielding shell, an insulation body clad with the shielding shell, and signal terminals received in the insulation body. The shielding shell has a first wall, and ground terminals extend towards the insertion interface and are bent towards the interior of the shielding shell from a mating side of the first wall close to the mating surface. A protection body corresponding to each ground terminal is disposed on the rust wall, and each protection body includes a guide portion located on one side of each protection body close to the insertion interface and a stopping portion extended from the guide portion. The guide portion is closer to the insertion interface than the contact portion of the ground terminal, and the height of the stopping portion is lower than that of the contact portion.

6 Claims, 13 Drawing Sheets

ELECTRICAL CONNECTOR SHIELDING SHELL

This application is a national phase application of PCT Application No. PCT/US2007/002188, filed Jan. 26, 2007, which in turn claims priority to Chinese Application No. 20062002130.X, filed Jan. 26, 2006.

FIELD OF THE INVENTION

The present invention relates to an electrical connector, and more particularly to an electrical connector which has ground terminals and can be connected to a counterpart.

BACKGROUND OF THE INVENTION

As shown in FIG. 1, China Patent No. 02286721 discloses an existing electrical connector. The electrical connector includes an insulation body 7, a shielding shell 8, and several signal terminals C received in the insulation body 7.

The insulation body 7 includes a base 70 and a mating portion 71 vertically extending from a side of the base 70 in the longitudinal direction. One surface of the base 70 from where the mating portion 71 extends is a mating surface 700. Several receiving slots 701 penetrate through the other side of the base 70 opposite the mating portion 71, and several accommodation slots 710 are disposed on a side wall of the mating portion 71 facing the receiving slot 701, and each accommodation slot 710 integrally penetrates through the base 70. Each signal terminal C is inserted in the corresponding accommodation slot 710.

The shielding shell 8 covers the external surface of the insulation body 7, and has a first retaining wall 80 and a second retaining wall 81 that are parallel to each other. The second retaining wall 81 has an abutting surface 810 that can abut against the mating surface 700 of the insulation body 7. The abutting surface 810 has a pin 811 at a position corresponding to the receiving slot 701 of the insulation body 7 reversely extending towards the insulation body 7, so as to be inserted in the receiving slot 701, and thereby the shielding shell 8 is joined to the insulation body 7. The second retaining wall 81 has several rectangular windows 812 disposed along a longitudinal direction at positions corresponding to the receiving slot 701 of the insulation body 7, and each window 812 has a cantilever-shaped ground terminal G extending from a side wall of the abutting surface 810 and away from the abutting surface 810. The ground terminal G extends towards the retaining wall 80 at a certain angle as a whole, and the free end of the ground terminal has a guide portion G protruding towards the first retaining wall 80 direction, so as to mate with the ground terminal (not shown) of the other electrical connector.

The ground terminal G extends from the sidewall of the window 812, and the elasticity of the ground terminal G is insufficient since the cantilever is too short. Additionally, the number of the signal terminals of the electrical connector is quite more than that of the ground terminals. When the mated electrical connector is plugged therein, the signal terminals disposed on the same side will act relatively large pressing force towards the ground terminals, and the ground terminals with a less amount are broken, down to cause permanent deformation or insufficient elasticity. The electrical connector does not have a function for guiding the mated electrical connector to be inserted so that the impact and pressing on the ground terminals cannot be reduced when the mated electrical connector is plugged therein. Therefore, the terminal is likely to be over pressed and permanently deformed.

In view of the above reasons, the existing electrical connector still needs to be improved, so as to achieve a more preferred grounding effect.

SUMMARY OF THE INVENTION

The present invention provides an electrical connector, which can effectively protect ground terminals from being over pressed to cause deformation.

The present invention provides an electrical connector, to which a mated electrical connector is connected through an insertion interface. The electrical connector comprises a shielding shell, an insulation body clad with the shielding shell, several signal terminals received in the insulation body and several ground terminals. The shielding shell has a first wall, and each ground terminal has a contact portion with a concave surface towards the first wall. A protection body is disposed on the first wall and extended along the side of each ground terminal.

In an embodiment, each of the protection bodies is a bump protruding from the first wall towards the interior of the shielding shell. In another embodiment, each of the protection bodies is a folded sheet bent from one side of the first wall close to the insertion interface and extends towards the interior the shielding shell. The protection body has a guide portion located on one end of the protection body close to the insertion interface, and a stopping portion extending from the guide portion. The guide portion is closer to the insertion interface than the contact portion of the ground terminal, and the height of the stopping portion is lower than that of the contact portion. In an embodiment, the insulation body has a mating surface facing the insertion interface, the first wall has a mating side close to the mating surface, and each ground terminal is bent from the mating side towards the interior of the shielding shell and extends towards the insertion interface.

The electrical connector according to the present invention has protection bodies for protecting the ground terminals, and the protecting bodies guide the mated electrical connector to be raised when the mated electrical connector is inserted. Thus, the mated electrical connector is stopped at an appropriate height during the insertion. Consequentially, the ground terminal cannot be over pressed and permanently deformed. Therefore, the stability of the electrical connection is improved, and the service life of the electrical connecter is prolonged.

BRIEF DESCRIPTION OF THE DRAWINGS

The organization and manner of the structure and operation of the invention, together with further objects and advantages thereof, may best be understood by reference to the following description taken in connection with the accompanying drawings wherein like reference numerals identify like elements in which:

FIG. 6(*a*) is a cross-sectional view of the electrical connector in FIG. 6 along the line of AA;

FIG. 6(*b*) is a cross-sectional view of the electrical connector in FIG. 6 along the line of BB;

FIG. 7(*a*) is a cross-sectional view of the electrical connector in FIG. 7 along the line of CC;

FIG. 7(*b*) is a cross-sectional view of the electrical connector in FIG. 7 along the line of DD;

FIG. 10(*a*) is a cross-sectional view of the electrical connector in FIG. 10 along the line of EE.

DETAILED DESCRIPTION OF THE DISCLOSED EMBODIMENTS

Figure 1:
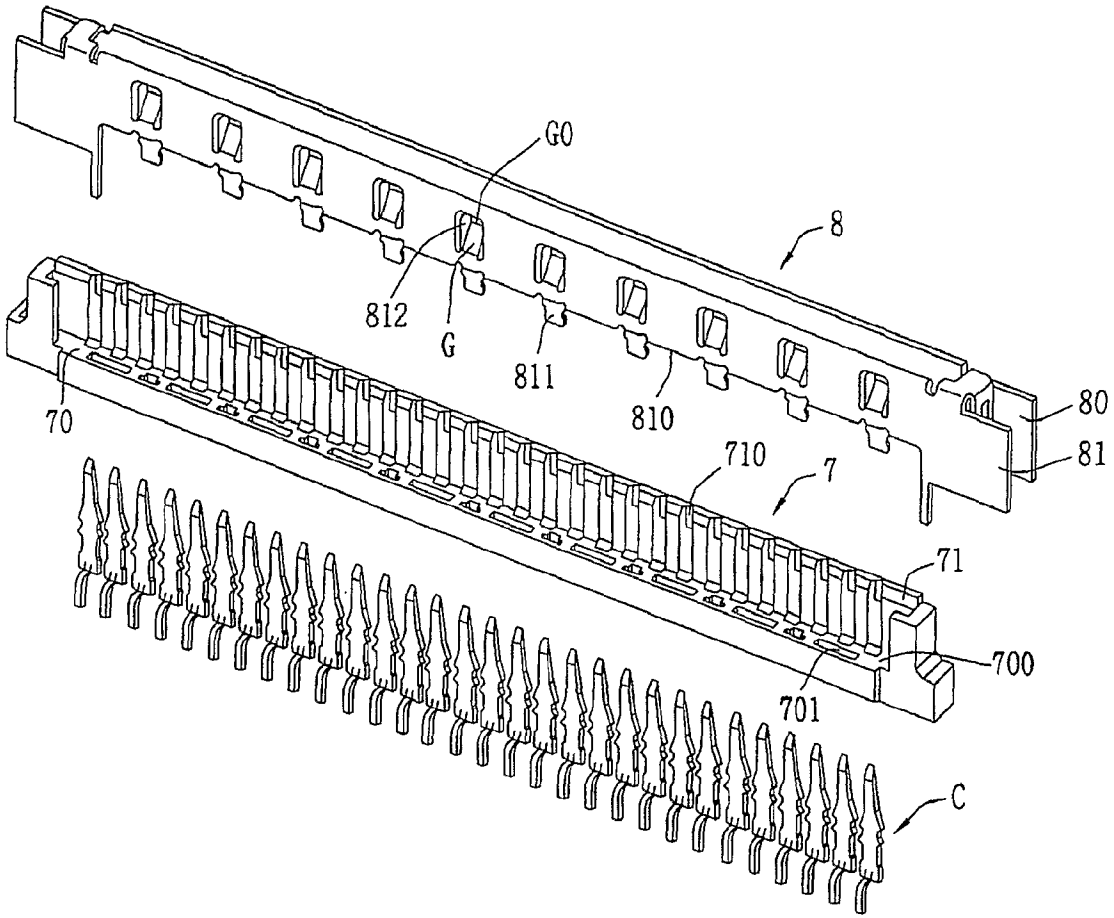
FIG. 1 (Prior Art)
FIG. 1 is an exploded stereogram of an existing electrical connector in the conventional art.

While this invention may be susceptible to embodiment in different forms, there is shown in the drawings and will be described herein in detail, a specific embodiment with the understanding that the present disclosure is to be considered an exemplification of the principles of the invention, and is not intended to limit the invention to that as illustrated.

Figure 2:
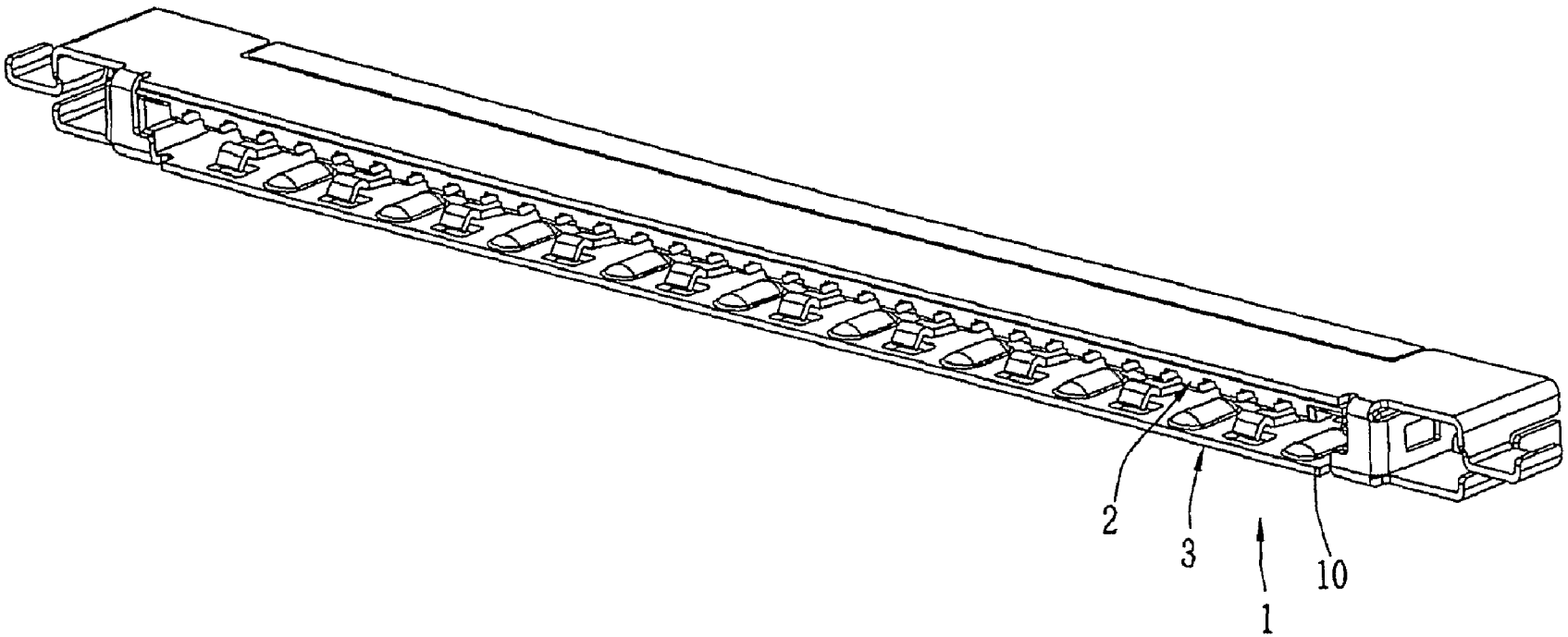
FIG. 2 is a stereogram of an electrical connector according to an embodiment of the present invention.
Figure 3:
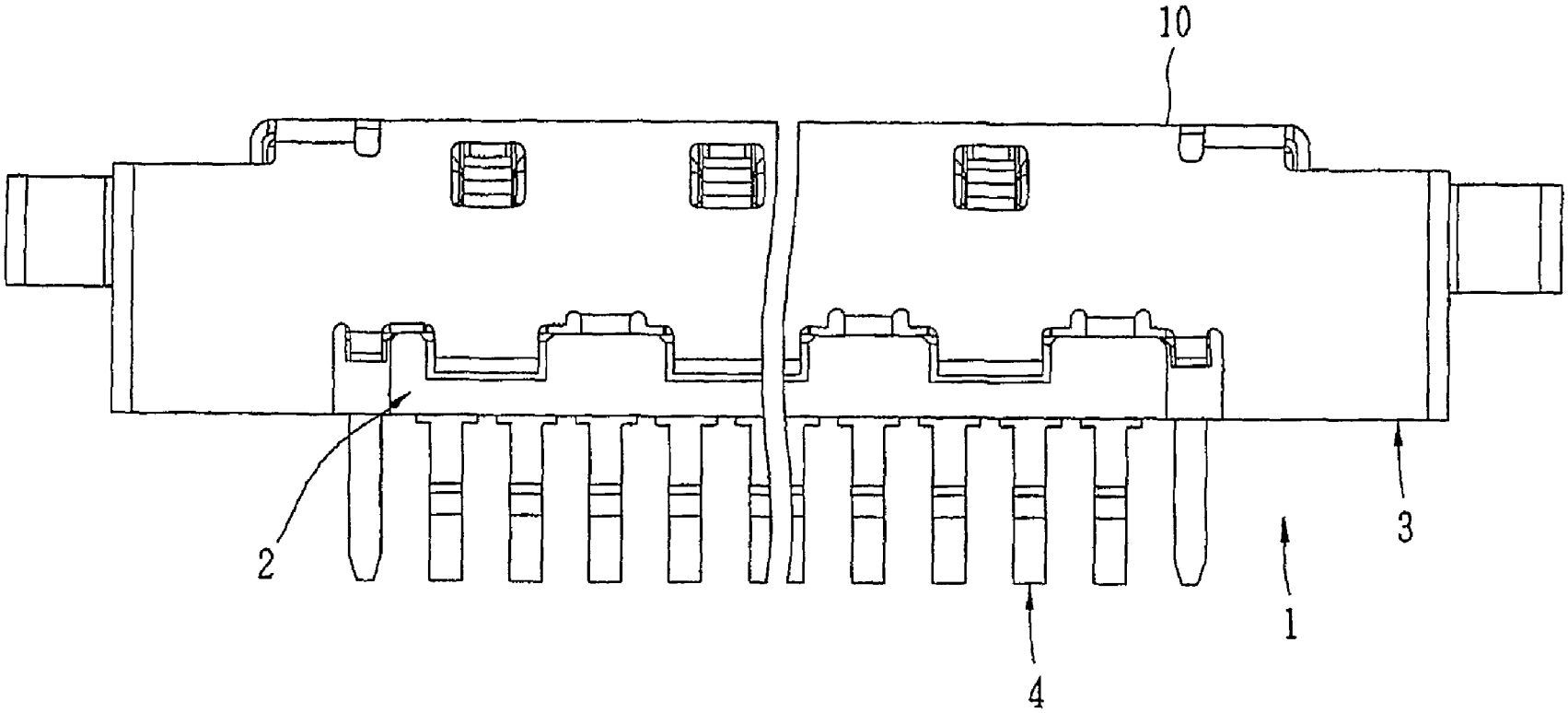
FIG. 3 is a cross-sectional bottom view of the electrical connector in FIG. 2.

As shown in FIGS. 2 and 3, an electrical connector 1 according to an embodiment of the present invention includes an insulation body 2, a shielding shell 3 for covering the insulation body 2, and several signal terminals 4 received in the insulation body 2. The electrical connector 1 can further be disposed on a circuit board P (not shown), for a mated electrical connector 5 to be inserted (referring to FIGS. 6(*a*), 6(*b*)) through an insertion interface 10, and thereby signal transmission is realized between each other.

Figure 4:
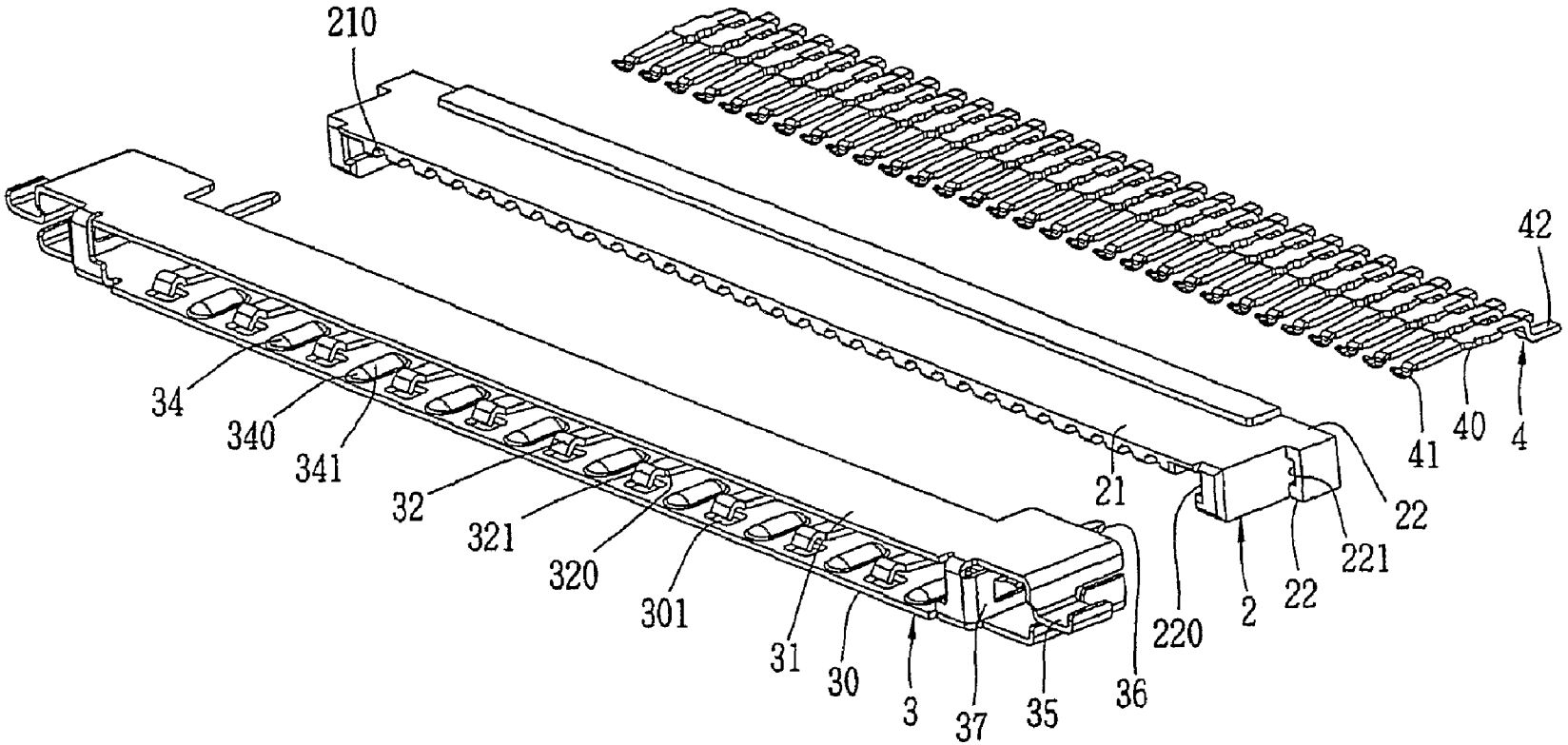
FIG. 4 is an exploded view of the electrical connector in FIG. 2.
Figure 5:
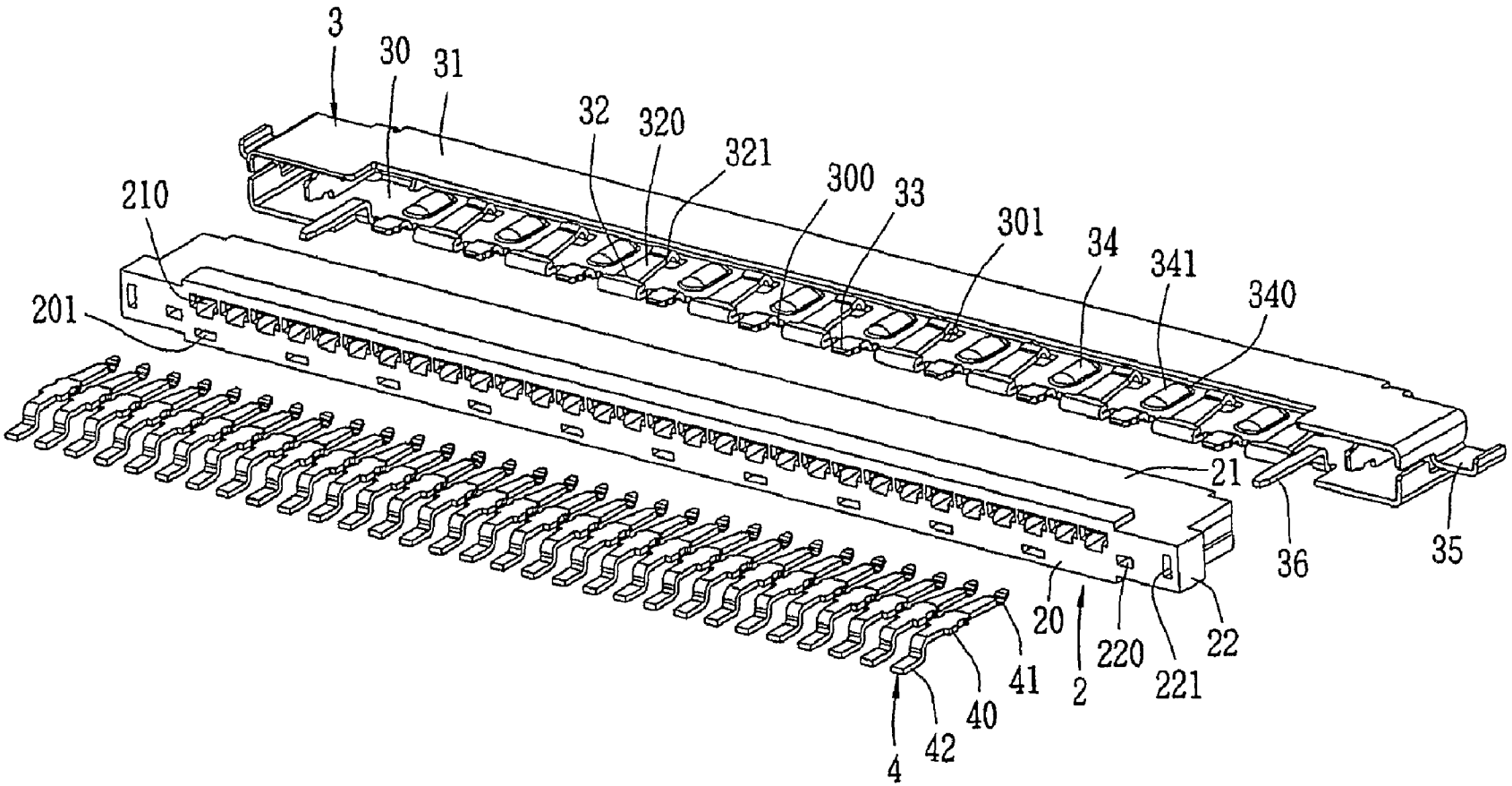
FIG. 5 is an exploded view the electrical connector in FIG. 2 from another perspective direction.
Figure 6:
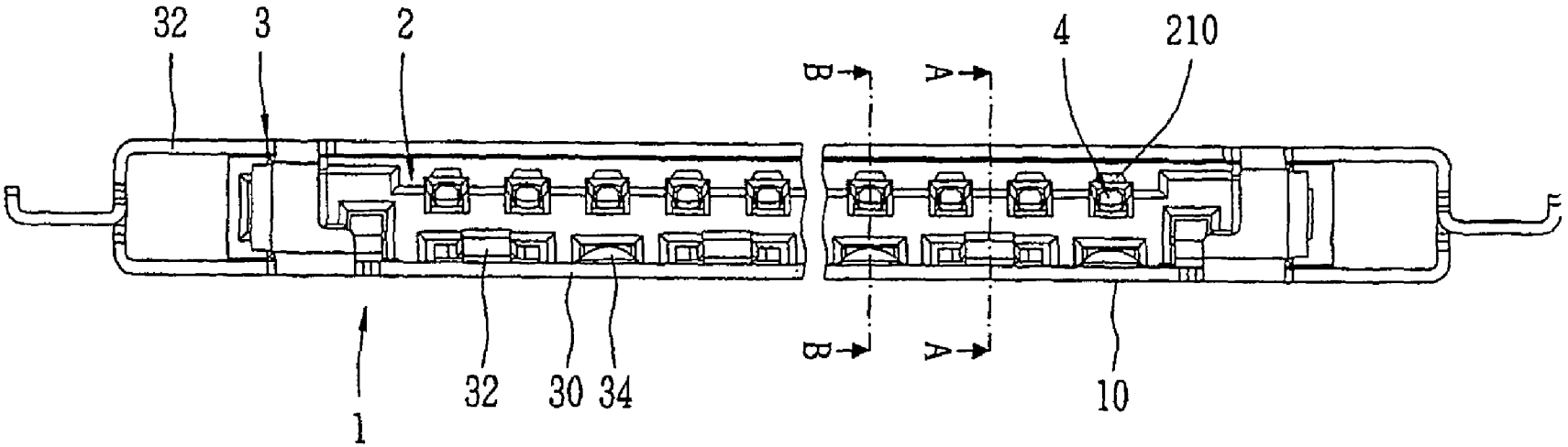
FIG. 6 is a front view of the electrical connector in FIG. 2.
Figure 6A:
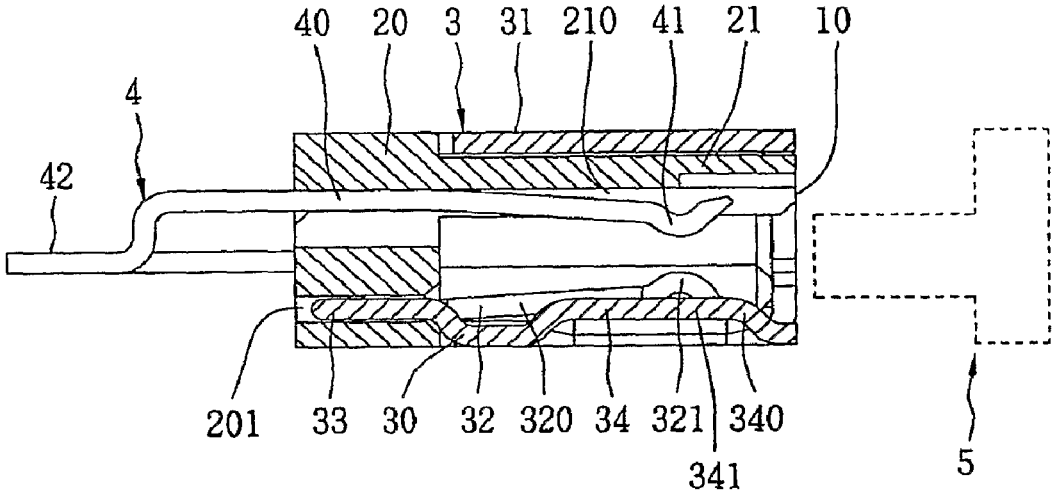
Figure 6B:
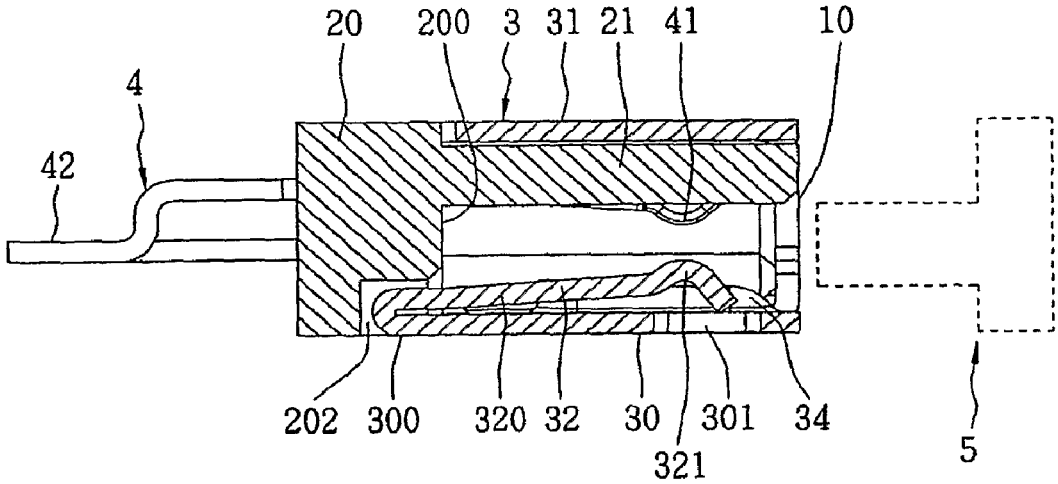

As shown in FIGS. 4, 5, 6, 6(*a*), and 6(*b*), an insulation body 2 of the electrical connector 1 according to an embodiment of the present invention includes a generally rectangular base 20 and a mating portion 21 vertically extending from one side of a mating surface 200 of the base 20. The mating surface 200 is one surface facing the insertion interface 10 of the electrical connector 1. Several first retaining slots 201 disposed on the mating surface 200 are opposite to the extension side of the mating portion 21 and go through to their opposite surface. A groove 202 is formed on the mating surface 200 between adjacent first retaining slots 201. Several terminal receiving slots 210 are disposed on the sidewall of the mating portion 21 close to the first retaining slot 201. The terminal receiving slots 210 extend vertical to the mating surface 200, and integrally penetrate through the base 20. Additionally, a trapezoidal portion 22 protrudes on two side surfaces of the short edges of the base 20 and the mating portion 21. An accommodation slot 220 and a second retaining slot 221 extend on each trapezoidal portion 22 and along the lengthwise direction of the first retaining slot 201, and the second retaining slot 221 is located on the external side.

The shielding shell 3 has a first wall 30 and a second wall 31 opposite the first wall 30. One side of the first wall 30 close to the mating surface 200 of the insulation body 2 is a mating side 300, and several ground terminals 32 extend from the mating side 300 corresponding to the groove 202 of the insulation body 2. The ground terminals 32 are bent from the mating side 300 towards the interior of the shielding shell 3 and extend towards the insertion interface 10, and has an elastic arm 320 with a sufficiently length and a contact portion 321 having a concaved surface towards the first wall 30 on the free end of the elastic arm 320. The contact portion 321 can contact the ground terminal of the mated electrical connector 5. Several windows 301 corresponding to the contact portion 321 are formed on the first wall 30 to provide sufficient connection spaces. At the side of each ground terminal 32, several retaining portions 33 substantially horizontally protrude from the mating side 300. Each retaining portion 33 can be received in the corresponding first retaining slot 201 of the insulation body 2, and thereby the shielding shell 3 and the insulation body 2 is combined together. Several protection bodies 34 corresponding to the retaining portions 33 protrude from the first wall 30 towards the interior of the shielding shell 3 on the side of each ground terminal 32. In this embodiment, each protection body 34 is a semi-cylindrical shaped block, which has a guide portion 340 facing the insertion interface 10 and a stopping portion 341 extending from the guide portion 340 towards the mating side 300. The guide portion 340 located on the front end of the protecting body 34 is closer to the insertion interface 10 than the contact portion 321 of each ground terminal 32, and the height of the stopping portion 341 is lower than that of the contact portion 321 of each ground terminal 32. In this way, when the mated electrical connector 5 is inserted into the electrical connector 1 through the insertion interface 10, it is firstly raised by the guide portion 340 of the protecting body 34. Consequentially, the ground terminal 32 is effectively prevented from being over depressed and deformed. Such permanent and excessive deformation is caused from that the electrical connector 1 is put at excessively low position. When the mated electrical connector 5 is connected with the electrical connector 1 of the present invention, due to the restriction on the height of the stopping portion 341, the contact portions 321 of each ground terminal 32 of the electrical connector 1 are at most pushed to a height equal to that of the stopping portion 341, and thereby the ground terminals 32 are prevented from being over pressed and permanently deformed.

Figure 7:
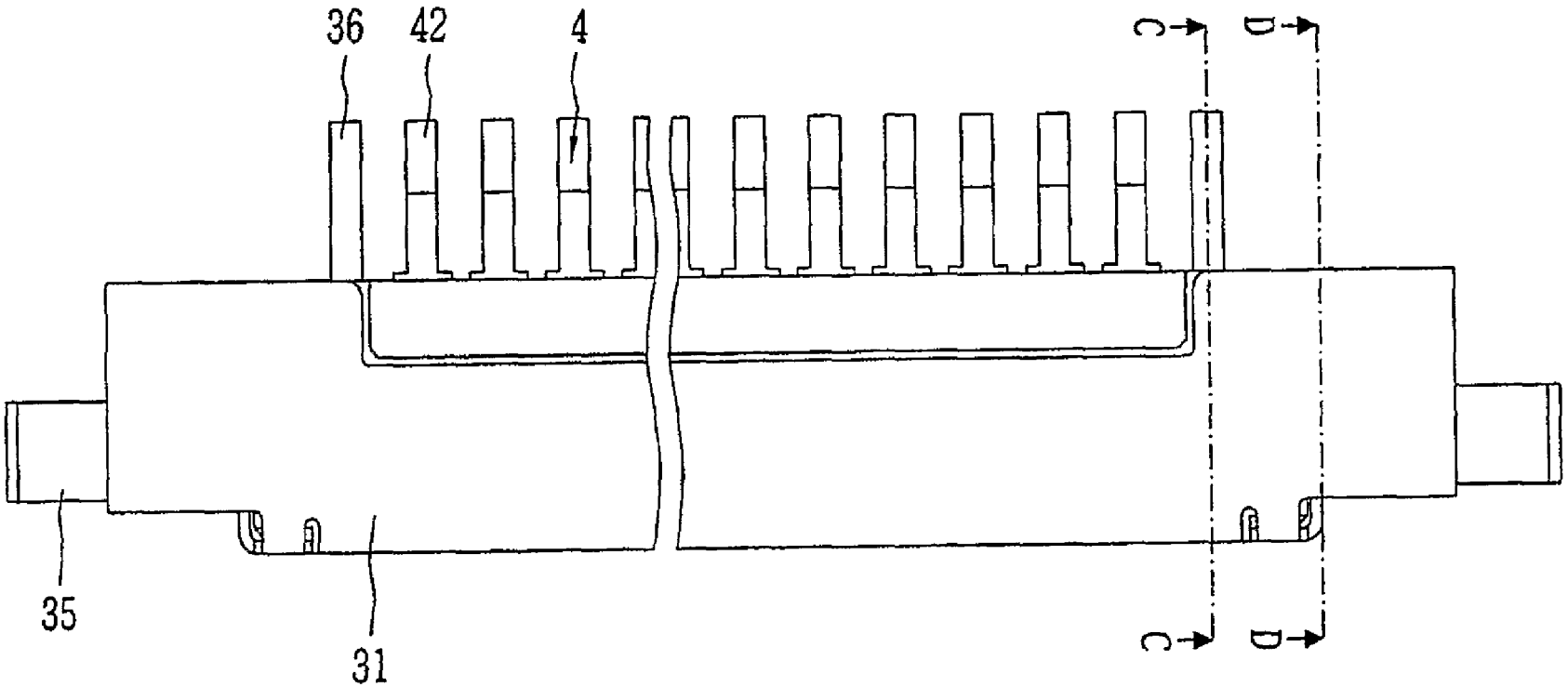
FIG. 7 is a top view of the electrical connector in FIG. 2.
Figure 7A:
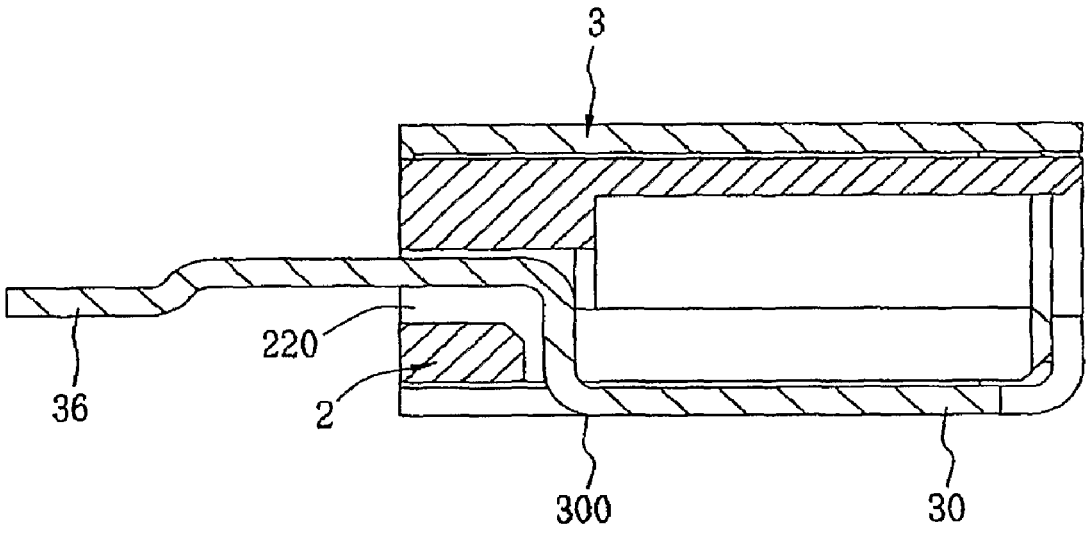
Figure 7B:
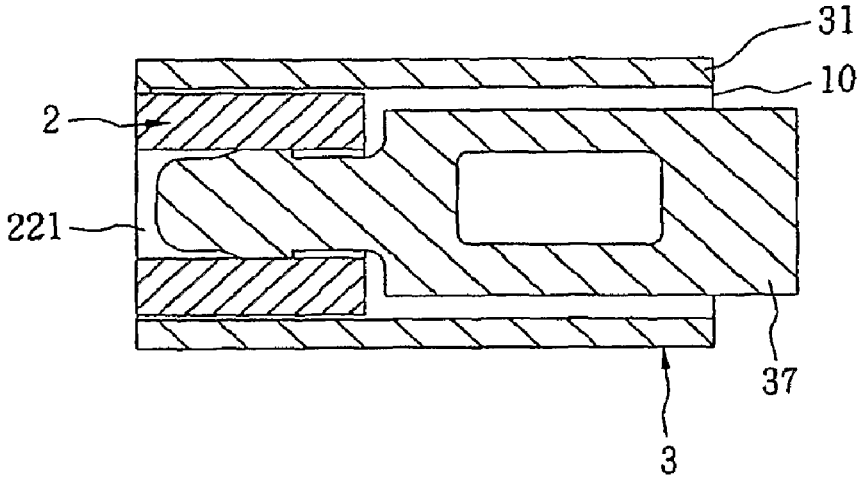

Additionally, referring to FIGS. 4, 5, 7, and 7(*a*), in order to fix the shielding shell 3 on the circuit board, a fixing portion 35 is bent and extends from each of two sides of the second wall 31 (also can be the first wall 30) of the shielding shell 3. A welding pin 36 is respectively bent and extends from each of two ends of the mating side 300 of the first wall 30, and the welding pin 36 can be accommodated in the accommodation slot 220 of the insulation body 2. The free ends of the fixing portion 35, the welding pin 36 and the rear portions 42 of the signal terminals 4 are at the same level, and thereby they are welded on the circuit board P all together. Referring to FIGS. 4, 5, 7, and 7(*b*), a retaining sheet 37 corresponding to each of the second retaining slots 221 of the insulation body 2 extends towards the interior of the shielding shell 3 from two ends of the shielding shell 3 close to the insertion interface 10, and the retaining sheet 37 is mated and interfered with the second retaining slot 221 and further holds the shielding shell 3 and the insulation body 2 together.

Figure 8:
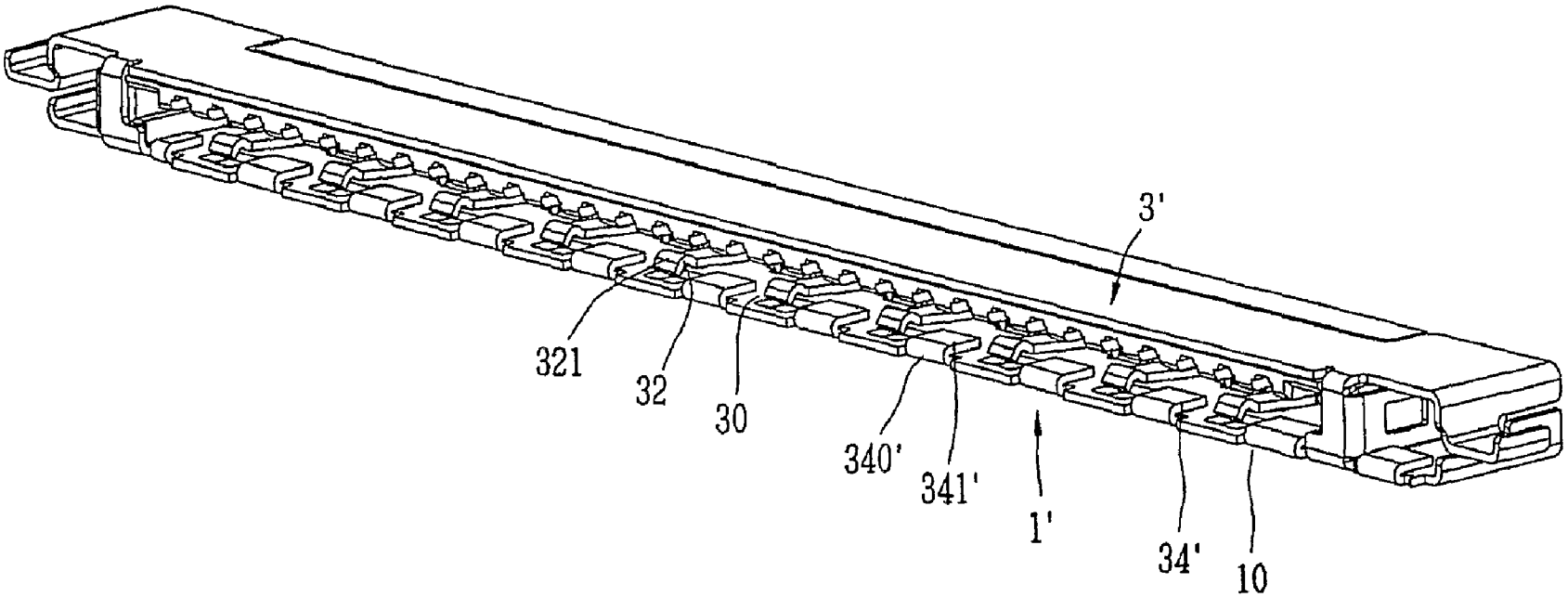
FIG. 8 is a stereogram of an electrical connector according to another embodiment of the present invention.
Figure 9:
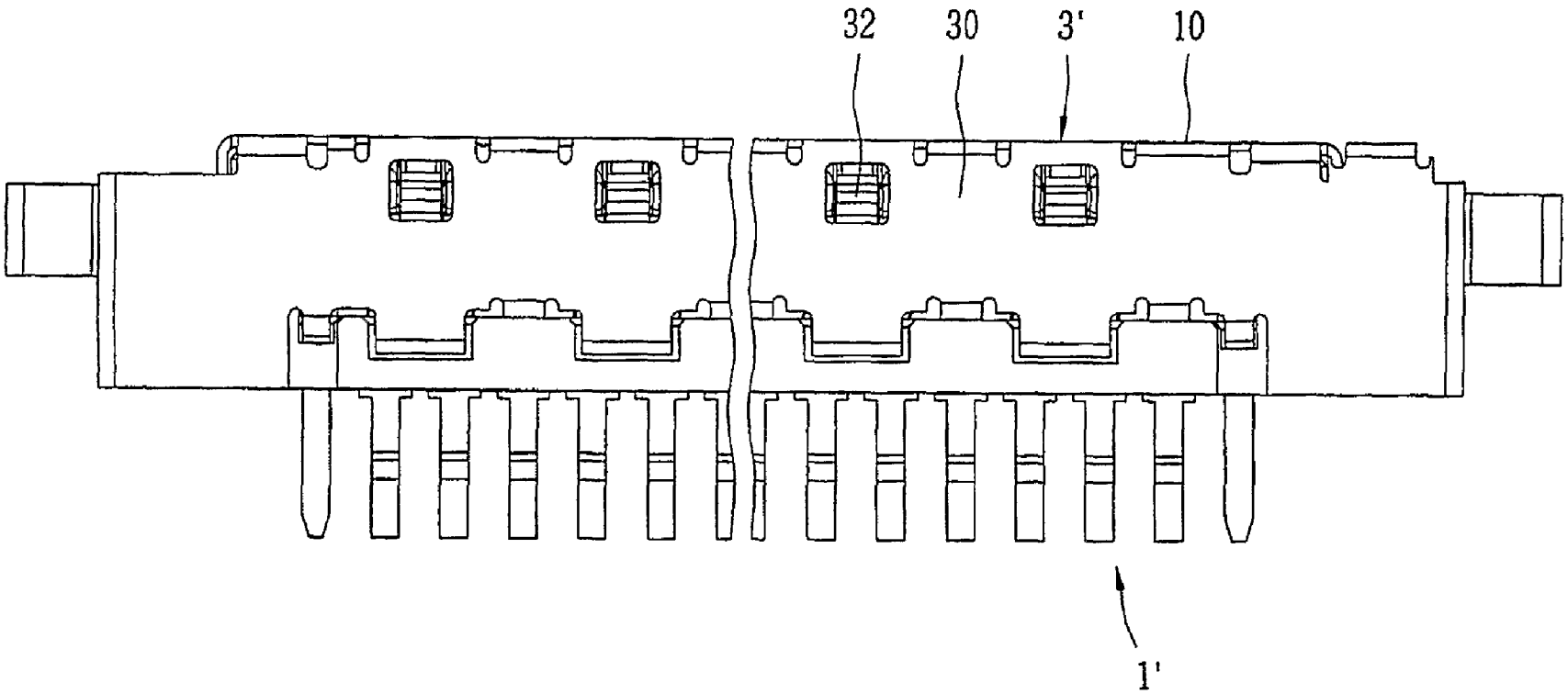
FIG. 9 is a cross-sectional bottom view of the electrical connector in FIG. 8.
Figure 10:
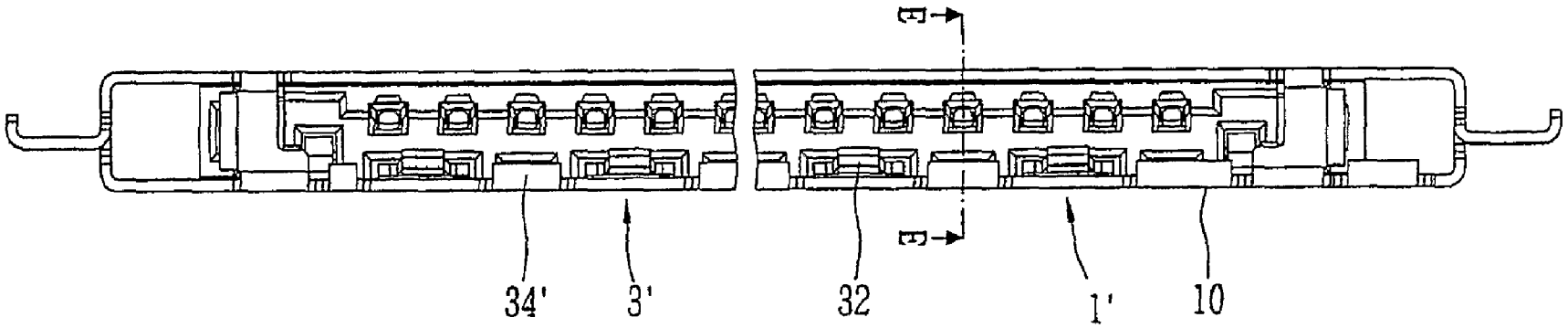
FIG. 10 is a front view of the electrical connector in FIG. 8.
Figure 10A:
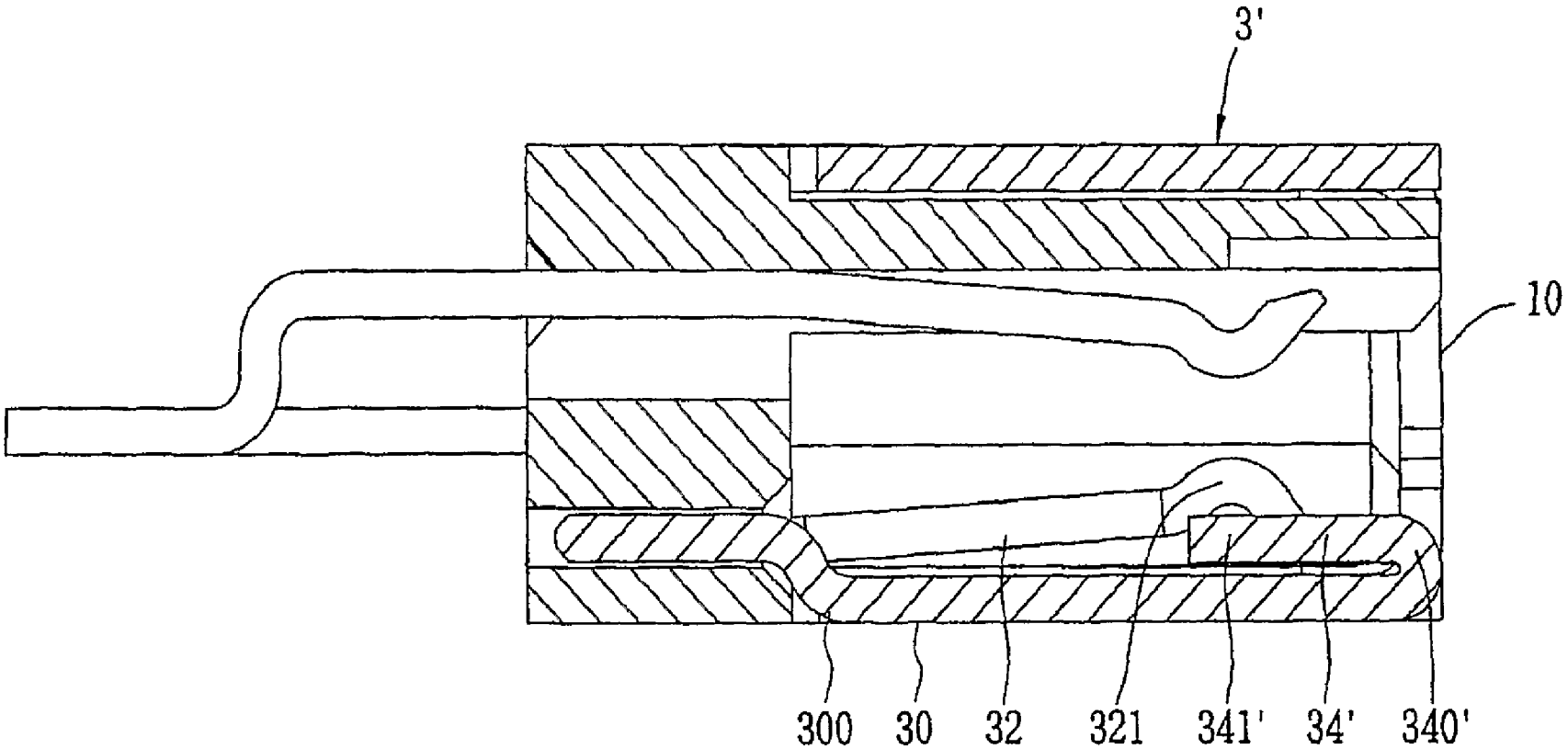

As shown in FIGS. 8, 9, 10, and 10(*a*), in accordance with another embodiment of the present invention, an electrical connector 1' has a protection body 34' which is a folded sheet. The protection body 34' is bent backward from one side of the first wall 30 opposite the mating side 300 and extends towards the interior of the shielding shell 3', and has a guide portion 340' bent from one side close to the insertion interface 10. A stopping portion 341' horizontally extends from the guide portion 340' towards the mating side 300. Similarly, the guide portion 340' on the front end of the protecting body 34' is closer to the insertion interface 10 than the contact portion 321 of the ground terminal 32, and the stopping portion 341' at least extends towards the side of the contact portion 321, and the height of the stopping portion 341' is lower than that of the contact portion 321.

The electrical connector of the present invention has protection bodies for protecting the ground terminals, and particularly, the mated electrical connector can be raised upon being guided by the guide portion of the protection body when being inserted in. The mated electrical connector can be stopped at an appropriate height by the stopping portion of the protecting body, and thereby the ground terminal is prevented from being over pressed and permanently deformed. Furthermore, the ground terminals extend from the mating side of the first wall. The elasticity of the ground terminal is greatly increased in comparsion with the existing ground terminal extending from the window so that the ground terminals are prevented from being deformed effectively.

While a preferred embodiment of the invention is shown and described, it is envisioned that those skilled in the art may devise various modifications without departing from the spirit and scope of the foregoing description and the appended claims.

What is claimed is:

1. An electrical connector connected to a mated electrical connector through an insertion interface, comprising a shielding shell having a plurality of ground terminals, an insulation body covered by the shielding shell and a plurality of signal terminals received in the insulation body, wherein the shielding shell has a first wall, each ground terminal has a contact portion concaved towards the first wall, wherein a protection body is disposed on the first wall and extends along a side of at least one of the ground terminals.

2. The electrical connector of claim 1, wherein the protecting body is a bump protruding from the first wall towards the interior of the shielding shell.

3. The electrical connector of claim 1, wherein each of the protecting body is a folded sheet bent from one side of the first wall close to the insertion interface and extending towards the interior the shielding shell.

4. The electrical connector of claim 1, wherein the protection body comprises a guide portion and a stopping portion extending from the guide portion, and the guide portion is located on one side of the protection body close to the insertion interface.

5. The electrical connector of claim 4, wherein the guide portion is closer to the insertion interface than the contact portion of the ground terminal, and the height of the stopping portion is lower than the height of the contact portion.

6. The electrical connector of claim 1, wherein the insulation body has a mating surface facing the insertion interface, the first wall has a mating side close to the mating surface, and each of the ground terminals is bent from the mating side towards the interior of the shielding shell and extends towards the insertion interface.

* * * * *